US006786213B1

(12) United States Patent
Lee

(10) Patent No.: US 6,786,213 B1
(45) Date of Patent: Sep. 7, 2004

(54) SLINGSHOT

(76) Inventor: Aldric Kuo-Chun Lee, 4525 Production Dr., Dallas, TX (US) 75235

( * ) Notice: Subject to any disclaimer, the term of this patent is extended or adjusted under 35 U.S.C. 154(b) by 0 days.

(21) Appl. No.: 10/620,820

(22) Filed: Jul. 16, 2003

(51) Int. Cl.[7] ..... F41B 3/02
(52) U.S. Cl. ..... 124/20.1
(58) Field of Search ..... 124/20.1, 20.3

(56) References Cited

U.S. PATENT DOCUMENTS 2,613,659 A * 10/1952 Hutson ..... 124/20.3
2,820,444 A * 1/1958 Pedersen ..... 124/20.1
3,983,860 A * 10/1976 Bolton ..... 124/20.1
4,877,007 A * 10/1989 Olson ..... 124/22
5,072,715 A * 12/1991 Barr ..... 124/20.1
5,579,751 A * 12/1996 Lin ..... 124/20.1
5,894,672 A * 4/1999 Ellenburg et al. ..... 33/265

* cited by examiner

*Primary Examiner*—John A. Ricci
(74) *Attorney, Agent, or Firm*—Harry C. Post, III

(57) ABSTRACT

A slingshot body for use with an elastic member in slinging a projectile. A fork portion to which the elastic member is to be attached and a gripping portion to be grasped by a user of the slingshot body are provided. Mounting apparatus pivotally connects the fork portion and the gripping portion to one another to allow movement of the gripping portion within the user's hand.

27 Claims, 5 Drawing Sheets

SLINGSHOT

BACKGROUND OF THE INVENTION

This invention relates to a slingshot and, more particularly, to a slingshot body for use with an elastic member in slinging a projectile.

Slingshots have been used for many years. Normally, a user of the slingshot wraps a pouch around a projectile, overcomes the resistance caused by elastic members connected to the arms of a forked portion of the body and moves the pouch into a projectile launching position. Unless the user holds the forked portion exactly perpendicular to a projectile release point, the elastic members may apply unequal forces to the pouch. In which event, the projectile will not fly as true a course as the user desires. Further, after the projectile is released, the user may change his or her grip on the slingshot body that will effect the positioning of the forked portion relative to the release point and result in a lack of repeatability in using the slingshot. In order to eliminate these problems, an improved slingshot body is provided for use by a slingshot user.

Accordingly, it is an object of the present invention to provide a slingshot body for use with an elastic member in slinging a projectile. Since the slingshot body has a fork portion pivotally connected to a gripping portion, the fork portion is disposed perpendicular to a user's arm and equal force is applied to the pouch supporting the projectile and thereby improve the flight of the projectile toward the target.

BRIEF SUMMARY OF THE INVENTION

In accordance with the present invention, there is provided a slingshot body for use with an elastic member in slinging a projectile. A fork portion to which the elastic member is to be attached and a gripping portion to be grasped by a user of the slingshot body are provided. Mounting apparatus pivotally connects the fork portion and the gripping portion to one another to allow movement of the gripping portion within the user's hand without effecting the force applied on each side of the pouch by the elastic members.

Further, in accordance with the present invention, there is provided a slingshot body for use with an elastic member in slinging a projectile. A fork portion to which the elastic member is to be attached and a gripping portion to be grasped by a user of the slingshot body are provided. Pivotal connecting apparatus is then used to pivotally connect the elastic member to said fork portion.

Further, in accordance with the present invention, there is provided a slingshot body for use with an elastic member in slinging a projectile. A fork portion to which the elastic member is to be attached and a gripping portion to be grasped by a user of the slingshot body are provided. A stabilizing member is used to inhibit undesired movement of said fork portion.

BRIEF DESCRIPTION OF THE SEVERAL VIEWS OF THE DRAWING

Objects and advantages of the invention will become apparent upon reading the following detailed description and upon reference to the drawings, wherein like reference characters are used throughout to designate like parts.

DETAILED DESCRIPTION OF THE INVENTION

Figure 1:
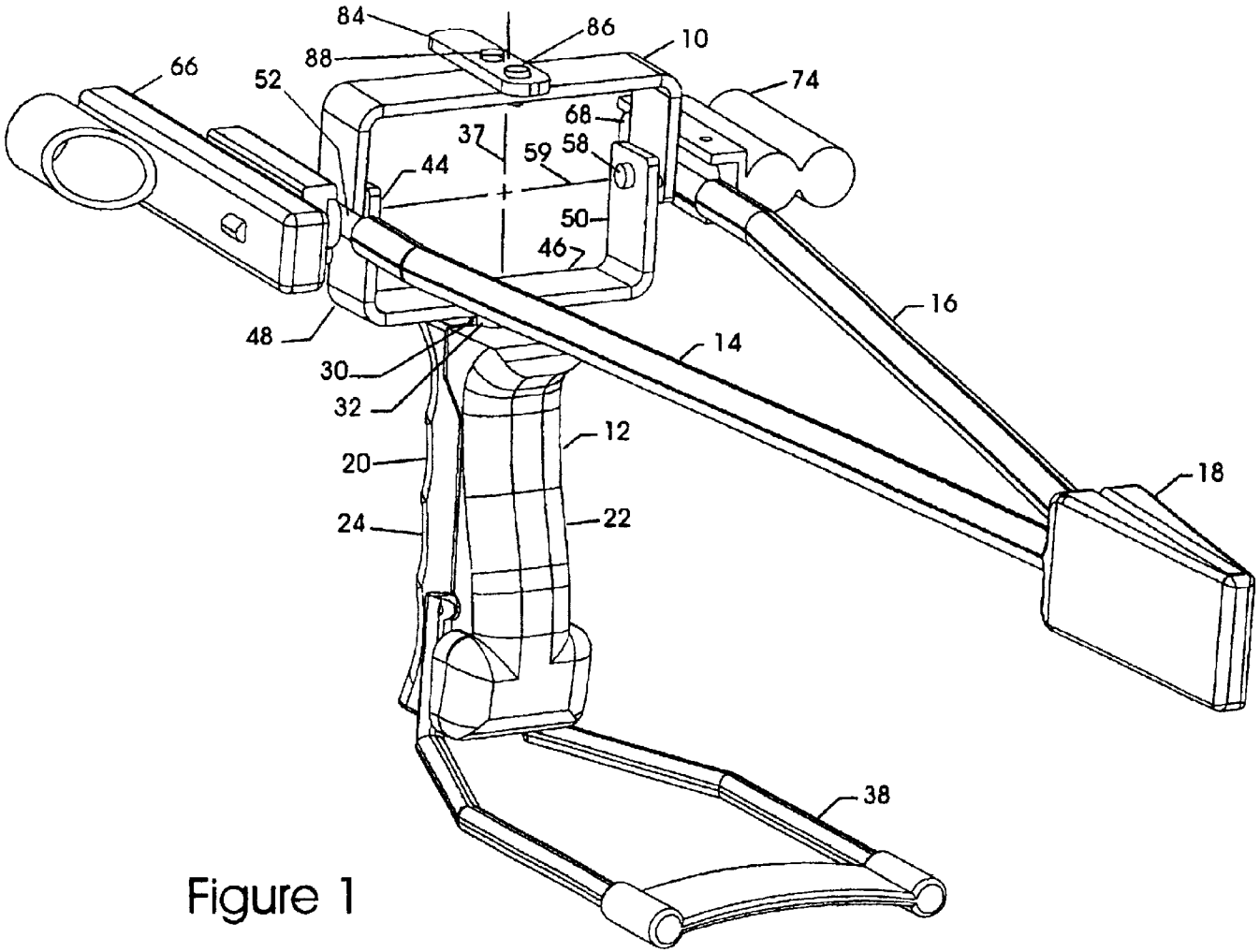
FIG. 1 is a perspective view of a slingshot constructed according to the present invention with separate sights.

Turning now to the drawing, there is shown a slingshot 10 with a slingshot body 12, first and second conventional elastic members 14 and 16, respectively, and a conventional pouch 18 for supporting a projectile (not shown).

Figure 2:
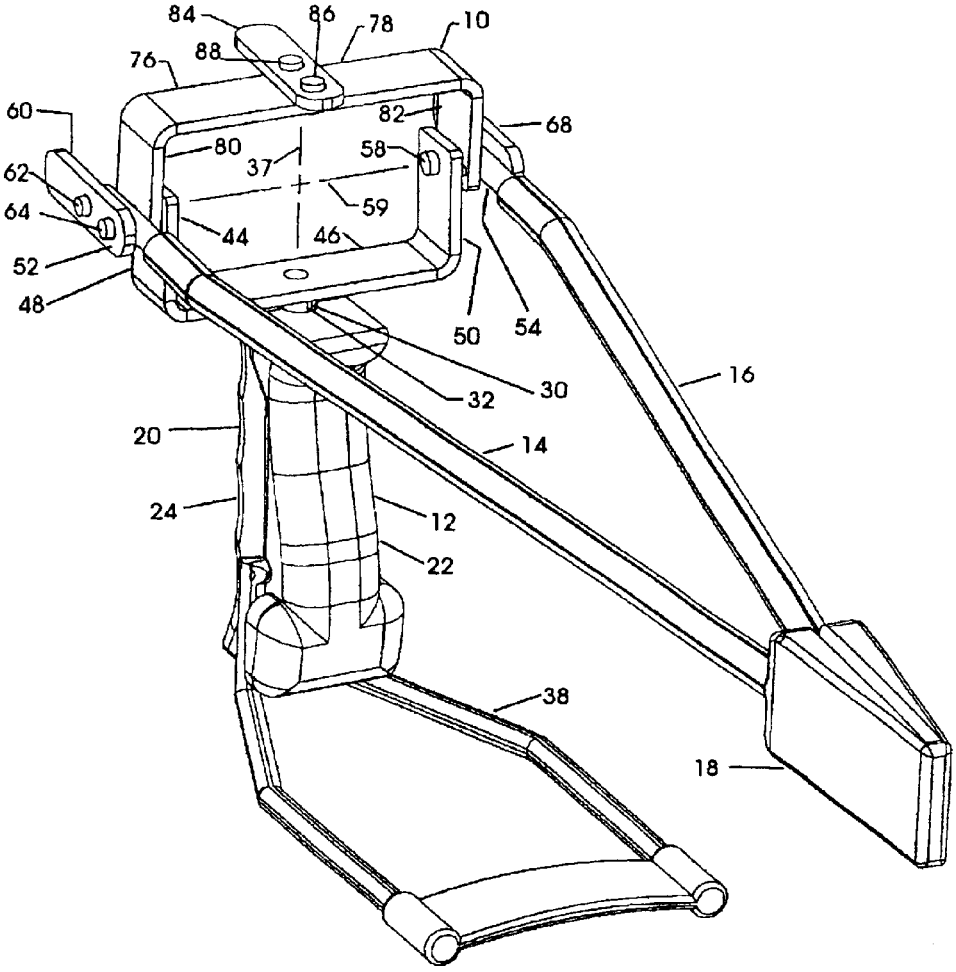
FIG. 2 is a perspective view of a slingshot constructed according to the present invention without sights.
Figure 3:
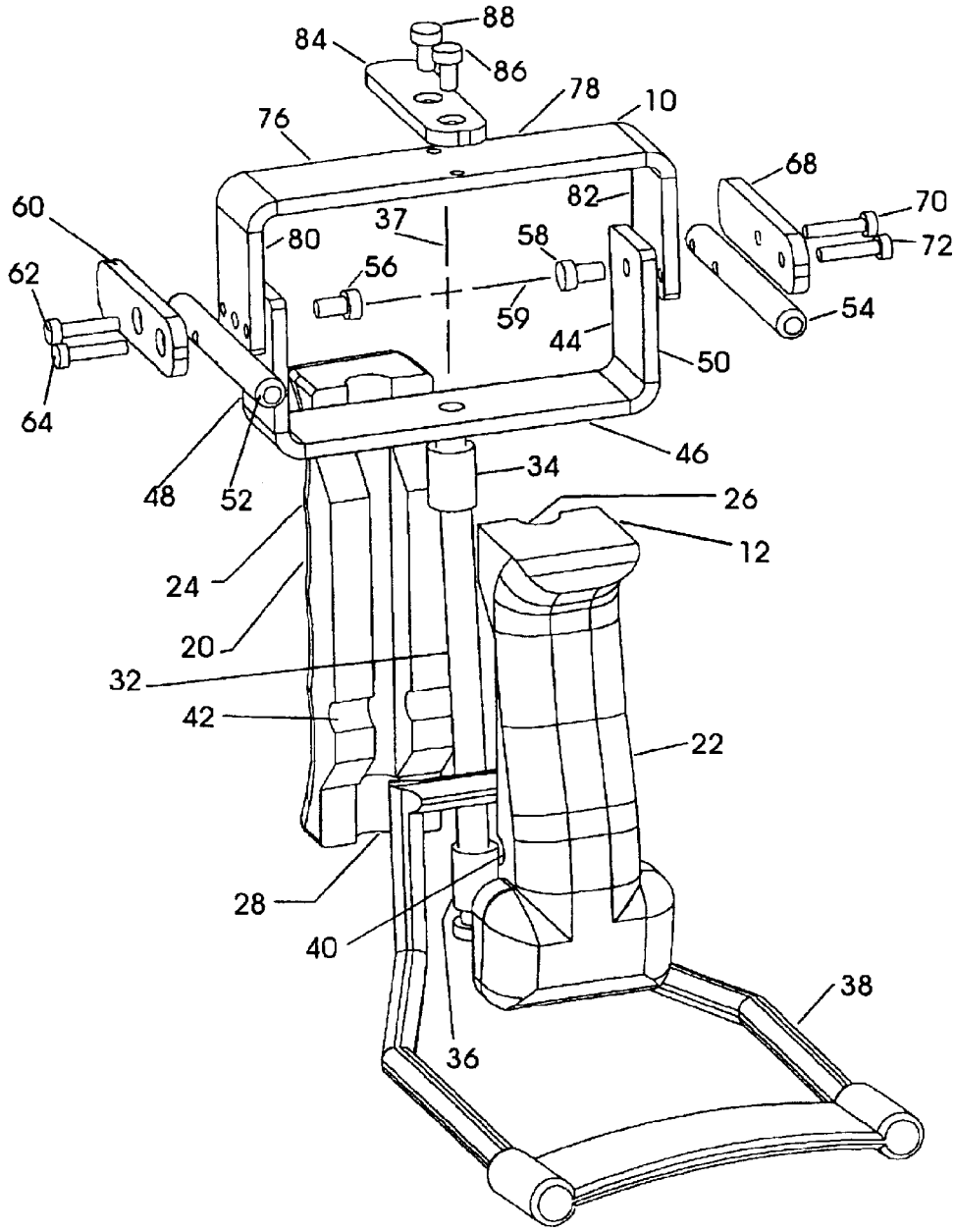
FIG. 3 is an exploded perspective view of a portion of the slingshot shown in FIG. 2.

As best seen in FIG. 2, slingshot body 12 has a gripping portion 20 to be grasped by a user of slingshot 10 and is elongated with a length sufficient to be engaged and gripped by a hand of the user of slingshot 10. Gripping portion 20 is constructed with a user side portion 22 generally facing toward the user and a target side portion 24 generally facing away from the user. User side portion 22 and target side portion 24 are constructed to complementary engage one another and form elongated gripping portion 20 when joined together in a conventional manner. User side portion 22 is constructed to generally conform to a palm of a user's hand when gripping portion 20 is held in the user's hand and target side portion 24 is constructed to form finger grips when gripping portion 20 is held in the user's hand. A complementary groove 26 and 28 is provided in each portion 22 and 24, respectively, to form an aperture 30 that extends into and through gripping portion 20 along its elongated length.

An axle 32 is disposed in upper bearing ring 34 and lower bearing ring 36 to permit rotation of the axle. Upper and lower bearing rings 34 and 36 are disposed within aperture 30 and connected to gripping portion 30 so that axle 32 is mounted for pivotal movement around an elongate axis 37 created by gripping portion 30.

When desired, a wrist support 38 can be pivotally mounted to gripping portion 20 by providing complementary grooves 40 and 42 in each portion 22 and 24, respectively. When wrist support 38 is pivotally connected to gripping portion 20, it can be rotated into the appropriate shooting position so that a user of slingshot 10 is provided support at his or her wrist in a conventional manner.

A fork portion 44 of slingshot 10 is pivotally connected to axle 32. Fork portion has a generally U-shaped configuration with a base 46 and generally upturned arms 48 and 50 that extend substantially transverse to base 46. Connected to base 46 is axle 32, which is disposed substantially equidistant between arms 48 and 50 and extends away from base 46 in a direction opposite to the direction that arms 48 and 50 extend away from base 46.

First and second elongated connecting rods 52 and 54 are pivotally connected at one end in close juxtaposition to the outboard ends of upturned arms 48 and 50, respectively, by first and second connecting pins 56 and 58, respectively, and form a pivotal axis 59. Connected to the other end of rod 52 in a conventional manner is one end of elastic member 14 and to the other end of rod 54 in a conventional manner is one end of elastic member 16. The other ends of elastic members 14 and 16 are connected to pouch 18 in a conventional manner.

A first elongated sight mounting bracket 60 is connected to connecting rod 52 by pins 62 and 64 and pivotally rotates around first connecting pin 56 with connecting rod 52. Sight mounting bracket 60 has a configuration and size permitting a first conventional sight 66 to be secured to bracket 60. Examples of conventional sights that may be used as sight 66 are an electronic point sight that is sold under the name MAX SPEED by Daisy Manufacturing Company or a Laser Guide that is sold under the name AIR SHOT by Sighting Systems Instruments, LLC.

A second elongated sight mounting bracket 68 is connected to connecting rod 54 by pins 70 and 72 and pivotally rotates around second connecting pin 58 with connecting rod 54. Sight mounting bracket 68 has a configuration and size permitting a second conventional sight 74 to be secured to bracket 68. Examples of conventional sights that may be used as sight 74 are an electronic point sight that is sold under the name MAX SPEED by Daisy Manufacturing Company or a Laser Guide that is sold under the name AIR SHOT by Sighting Systems Instruments, LLC.

When desired, a stabilizing member 76 is used to inhibit undesired movement of fork portion 44. The preferred stabilizing member 76 has an inverted generally U-shaped configuration with a base 78 and generally down-turned arms 80 and 82 that extend substantially transverse to base 78. First and second arms 80 and 82, respectively, are attached to first and second connecting rods 52 and 54, respectively, by pins 62 and 64 and pins 70 and 72 to pivotally move with connecting rods 52 and 54.

When stabilizing member 76 is used, a third elongated sight mounting bracket 84 is connected to base 78 by securing pins 86 and 88 at a location where elongate axis 37 crosses base 78. Sight mounting bracket 84 has a configuration and size permitting a conventional sight (not shown) to be attached thereto. Examples of conventional sights that may be mounted to bracket 84 are an electronic point sight that is sold under the name MAX SPEED by Daisy Manufacturing Company or a Laser Guide that is sold under the name AIR SHOT by Sighting Systems Instruments, LLC.

Figure 4:
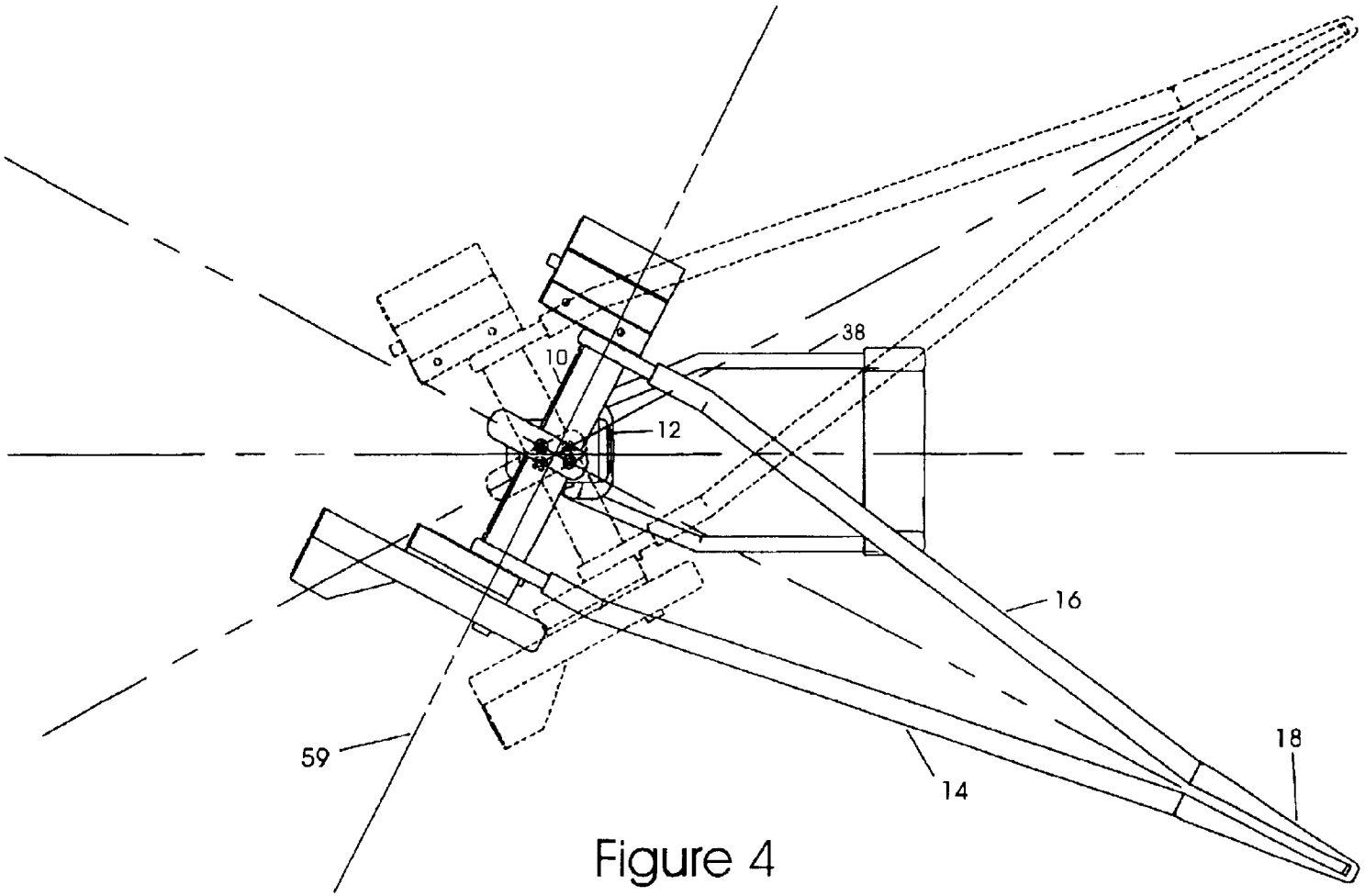
FIG. 4 is a top plan view of the slingshot shown in FIG. 1.
Figure 5:
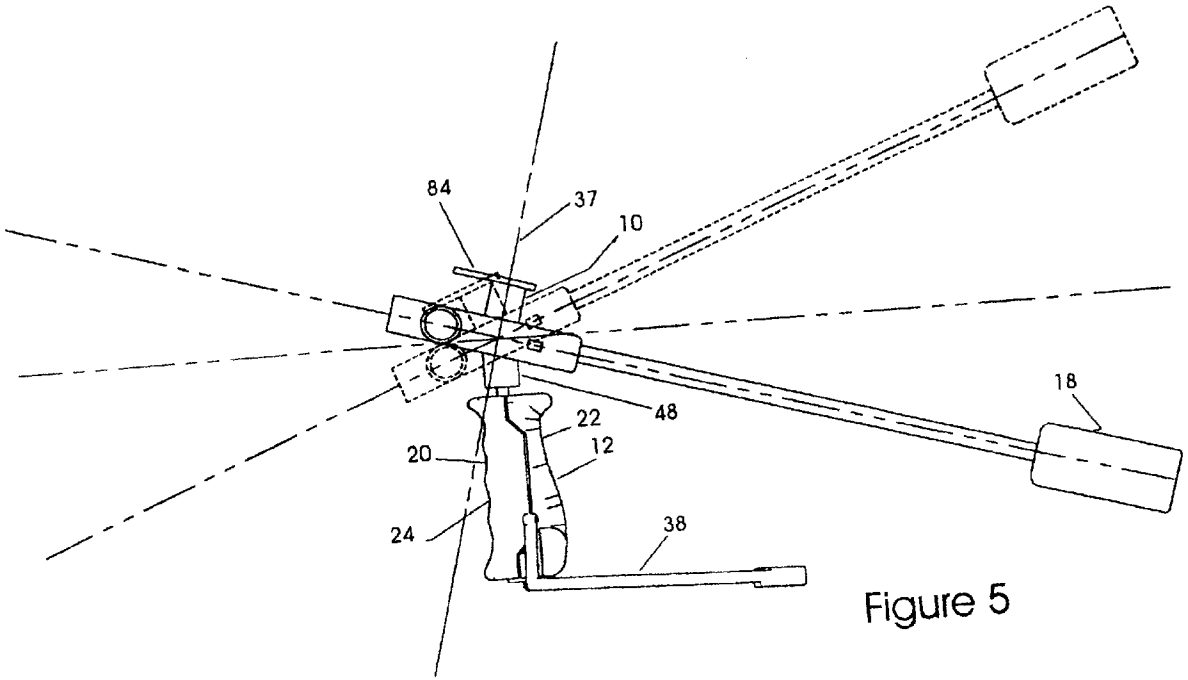
FIG. 5 is a side elevation view of the slingshot shown in FIG. 1.

As shown in FIGS. 4 and 5, when slingshot 10 is used, a user inserts his or her hand through wrist support 38 and grasps gripping portion 20 in a conventional manner. A projectile is then positioned in pouch 18 in a conventional manner and pouch 18 moved to a launching position, as indicated in solid outline. Should gripping portion 20 or pouch 18 be at a different launching position or point, as indicated in dotted outline, than previous launching positions, fork portion 44 of slingshot 10 rotates to align pouch 18 to be equidistant from arms 48 and 50. By this rotation into alignment, the launch point of pouch 18 is equidistant from arms 48 and 50 and the force provided by elastic members 14 and 16 should be equal. Thus, each projectile thrown from slingshot 10 should pass through the point where elongate axis 37 crosses pivotal axis 59 to, thereby, provide enhanced performance for the user through better repeatability of shots.

Moreover, the projectile should pass through the point where elongate axis 37 crosses pivotal axis 59 when slingshot 10 is held by the user in a generally vertical or upright position with a sight being used mounted on third mounting bracket 84 or when slingshot 10 is rotated 90° in a generally horizontal position with a sight being used mounted on first or second mounting brackets 60 and 68, respectively.

Further, by constructing slingshot body 10 with elongate axis 37 and pivotal axis 59 and these axes are in the same plane, arms 48 and 50 of fork portion 44 will be perpendicular to the launch point of pouch 18 when a user of slingshot 10 moves pouch 18 into a launch position, as shown in FIGS. 4 and 5.

The invention having been described, what is claimed is:

1. A slingshot body for use with an elastic member in slinging a projectile, comprising: a fork portion to which the elastic member is to be attached; a gripping portion to be grasped by a user of the slingshot body; mounting apparatus pivotally connecting said fork portion and said gripping portion to one another; and a stop member to prevent pivotal movement of said fork portion beyond a chosen angle relative to said gripping portion.

2. The slingshot body set forth in claim 1, further comprising: said gripping portion having an axis of elongation and said mounting apparatus having a pivotal axis that is disposed to extend substantially parallel to the axis of elongation.

3. The slingshot body set forth in claim 1, further comprising: said mounting apparatus including an axle connected to said fork portion and extending into said gripping portion.

4. The slingshot body set forth in claim 3, further comprising: said mounting apparatus including a bearing ring disposed in said gripping portion to engage the axle while allowing the axle to rotate within said gripping portion.

5. The slingshot body set forth in claim 1, further comprising: a sight mounting bracket for attaching a sight to said fork portion.

6. The slingshot body set forth in claim 1, further comprising: pivotal connecting apparatus for pivotally connecting the elastic member to said fork portion.

7. The slingshot body set forth in claim 6, further comprising: a sight mounting bracket for attaching a sight in close proximity to said pivotal connecting apparatus.

8. The slingshot body set forth in claim 6, further comprising: said pivotal connecting apparatus including first and second pivotal connectors disposed on said fork portion.

9. The slingshot body set forth in claim 8, further comprising: the first and second pivotal connectors having a pivoting axis, the pivoting axis being disposed to extend substantially coincidently with one another and to intersect with a pivotal axis of said mounting apparatus.

10. The slingshot body set forth in claim 8, further comprising: a sight mounting bracket for attaching a sight in close proximity to each of the first and second pivotal connectors.

11. The slingshot body set forth in claim 1, further comprising: a stabilizing member for inhibiting undesired movement of said fork portion.

12. The slingshot body set forth in claim 11, further comprising: said stabilizing member being disposed to extend between first and second arms of said fork portion.

13. The slingshot body set forth in claim 12, further comprising: pivotal connecting apparatus for pivotally connecting the elastic member to said fork portion; and said stabilizing member being pivotally connected to said fork portion in close proximity to said pivotal connecting apparatus.

14. The slingshot body set forth in claim 1, further comprising: said fork portion having first and second outboard ends; pivotal connecting apparatus for pivotally connecting the elastic member in close proximity to the first and second outboard ends of said fork portion; and a stabilizing member for inhibiting undesired movement of said fork portion pivotally connected in close proximity to said pivotal connecting apparatus.

15. The slingshot body set forth in claim 14, further comprising: a sight mounting bracket for attaching a sight connected to said stabilizing member.

16. A slingshot body for use with an elastic member in slinging a projectile, comprising: a fork portion to which the elastic member is to be attached, said fork portion having first and second outboard ends; pivotal connecting apparatus for pivotally connecting the elastic member in close proximity to the first and second outboard ends of said fork portion; a stabilizing member for inhibiting undesired movement of said fork portion pivotally connected in close proximity to said pivotal connecting apparatus; a gripping portion to be grasped by a user of the slingshot body; mounting apparatus pivotally connecting said fork portion and said gripping portion to one another; and a sight mounting bracket for attaching a sight connected to said stabilizing member, said sight mounting bracket being disposed on said stabilizing member in close proximity to a location where a pivotal axis of said mounting apparatus crosses the stabilizing member.

17. A slingshot body for use with an elastic member in slinging a projectile, comprising: a fork portion to which the elastic member is to be attached; a gripping portion to be grasped by a user of the slingshot body; and pivotal connecting apparatus for pivotally connecting the elastic member to said fork portion, said pivotal connecting apparatus including first and second pivotal connectors disposed on said fork portion, the first and second pivotal connectors having a pivoting axis, the pivoting axis being disposed to extend substantially coincidently with one another.

18. The slingshot body set forth in claim 17, further comprising: a sight mounting bracket for attaching a sight in close proximity to one of the first and second pivotal connectors.

19. The slingshot body set forth in claim 17, further comprising: a sight mounting bracket for attaching a sight in close proximity to each of the first and second pivotal connectors.

20. The slingshot body set forth in claim 19, further comprising: a stabilizing member for inhibiting undesired movement of said fork portion.

21. The slingshot body set forth in claim 20, further comprising: said stabilizing member being disposed to extend between first and second arms of said fork portion and along a side of the first arm facing away from the second arm and along a side of the second arm facing away from the first arm.

22. The slingshot body set forth in claim 17, further comprising: said fork portion having first and second outboard ends; said pivotal connecting apparatus having first and second pivotal connectors, the first pivotal connector disposed in close proximity to the first outboard end of said fork portion and the second pivotal connector disposed in close proximity to the second outboard end of said fork portion; and a stabilizing member for inhibiting undesired movement of said fork portion pivotally connected in close proximity to said pivotal connecting apparatus.

23. The slingshot body set forth in claim 22, further comprising: a sight mounting bracket for attaching a sight connected to said stabilizing member.

24. A slingshot body for use with an elastic member in slinging a projectile, comprising: a fork portion to which the elastic member is to be attached, said fork portion having first and second outboard ends; a gripping portion to be grasped by a user of the slingshot body; pivotal connecting apparatus for pivotally connecting the elastic member to said fork portion; pivotal connecting apparatus for pivotally connecting the elastic member in close proximity to the first and second outboard ends of said fork portion; a stabilizing member for inhibiting undesired movement of said fork portion pivotally connected in close proximity to said pivotal connecting apparatus; and a sight mounting bracket for attaching a sight connected to said stabilizing member, said sight mounting bracket being disposed on said stabilizing member in close proximity to a location where a pivotal axis of said mounting apparatus crosses the stabilizing member.

25. A slingshot body for use with an elastic member in slinging a projectile, comprising: a fork portion to which the elastic member is to be attached; a gripping portion to be grasped by a user of the slingshot body; and a stabilizing member for inhibiting undesired movement of said fork portion, said stabilizing member being disposed to extend between first and second arms of said fork portion and for a distance along a side of the first arm facing away from the second arm and along a side of the second arm facing away from the first arm.

26. The slingshot body set forth in claim 25, further comprising: pivotal connecting apparatus for pivotally connecting the elastic member to said fork portion; and said stabilizing member being pivotally connected to said fork portion in close proximity to said pivotal connecting apparatus.

27. The slingshot body set forth in claim 26, further comprising: mounting apparatus pivotally connecting said fork portion and said gripping portion to one another.

* * * * *